US008231210B2

(12) United States Patent
Tsukamoto

(10) Patent No.: US 8,231,210 B2
(45) Date of Patent: Jul. 31, 2012

(54) INKJET CARTRIDGE AND METHOD FOR MANUFACTURING THE SAME

(75) Inventor: Naoya Tsukamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 12/324,448

(22) Filed: Nov. 26, 2008

(65) Prior Publication Data

US 2009/0141099 A1 Jun. 4, 2009

(30) Foreign Application Priority Data

Nov. 30, 2007 (JP) ..... 2007-310919

(51) Int. Cl.
*B41J 2/175* (2006.01)

(52) U.S. Cl. ..... 347/87; 347/86

(58) Field of Classification Search ..... 347/84, 347/85, 86, 87
See application file for complete search history.

(56) References Cited

U.S. PATENT DOCUMENTS

| | | | | |
|---|---|---|---|---|
| 4,771,295 | A * | 9/1988 | Baker et al. | 347/87 |
| 5,237,342 | A | 8/1993 | Saikawa et al. | |
| 5,289,212 | A * | 2/1994 | Carlotta | 347/87 |
| 5,477,963 | A * | 12/1995 | Mochizuki et al. | 206/701 |
| 5,815,184 | A * | 9/1998 | Ujita et al. | 347/87 |
| 5,839,595 | A | 11/1998 | Ujita | |

FOREIGN PATENT DOCUMENTS

| | | |
|---|---|---|
| JP | 3-248848 | 11/1991 |
| JP | 8-224887 | 9/1996 |

* cited by examiner

*Primary Examiner* — Anh T. N. Vo
(74) *Attorney, Agent, or Firm* — Canon USA Inc IP Division

(57) ABSTRACT

An inkjet cartridge includes an ink absorber capable of being impregnated with ink and an ink-absorber container. The ink-absorber container includes a first housing containing a portion of the ink absorber and a second housing containing a remaining portion of the ink absorber which is not contained in the first housing. The first housing and the second housing are bonded together at bonding portions thereof. The ink absorber has a melted section at least in an area corresponding to the bonding portions, the processed section being formed by melting a surface of the ink absorber.

13 Claims, 13 Drawing Sheets

INKJET CARTRIDGE AND METHOD FOR MANUFACTURING THE SAME

BACKGROUND OF THE INVENTION

1. Field of the Invention

The present invention relates to an inkjet cartridge containing an ink absorber and a method for manufacturing the inkjet cartridge.

2. Description of the Related Art

FIG. 10 is a sectional side view illustrating an example of a known inkjet cartridge. This structure is described in Japanese Patent Laid-Open No. 3-248848 (corresponding to U.S. Pat. No. 5,237,342). In this structure, an inkjet recording head unit 105 includes an ink container and an inkjet recording head which are integrated with each other. More specifically, an ink container 101 which contains an ink absorber 102 for holding ink, a supply tube 104 for supplying ink to an ejection energy generating unit, and a recording head having a filter 103 disposed at an end of the supply tube 104 are integrated with each other.

This type of inkjet cartridge is replaced with another inkjet cartridge when it becomes impossible to eject ink. If the ink capacity of the inkjet cartridge is small, the inkjet cartridge must be frequently replaced, which is cumbersome for the user. The frequency of replacing the inkjet cartridge can be reduced by increasing the ink capacity thereof. In this case, the volume of the ink absorber and the volume of the ink-absorber container must be increased. However, if the size of the ink absorber and the size of the ink-absorber container are simply increased, severe conditions must be satisfied in the process of manufacturing the inkjet cartridge.

In general, the recording head is disposed on a bottom surface of the inkjet cartridge in the state in which the inkjet cartridge is mounted on a recording apparatus. The ink absorber is inserted through a top surface of the inkjet cartridge at the side opposite to the bottom surface. The ink is supplied to the recording head by pressing the ink absorber against the filter. Therefore, to increase the capacity of the inkjet cartridge without changing the installation area thereof in the recording apparatus, the space for holding ink in the ink-absorber container must be increased in the height direction thereof.

However, in such a case, the insertion stroke by which the ink absorber is inserted into the ink-absorber container increases. Therefore, it becomes difficult to press the ink absorber against the recording head disposed on the bottom surface. If the ink absorber cannot be tightly pressed against the filter, there is a risk that air bubbles will enter the inkjet cartridge and ink cannot be reliably supplied. In such a case, print quality will be degraded and thinning or the like will occur. Therefore, as the insertion stroke of the ink absorber increases, the conditions to be satisfied in the process of inserting the ink absorber become more severe.

An example of a method for solving this problem is described in Japanese Patent Laid-Open No. 8-224887 (corresponding to U.S. Pat. No. 5,839,595). This example is illustrated in FIGS. 11A and 11B. A first ink-absorber container 201 having a space for containing a first ink absorber 203 and a second ink-absorber container 202 having a space for containing a second ink absorber 204 are provided. The first ink-absorber container 201 and the second ink-absorber container 202 are connected to each other such that the first ink absorber 203 and the second ink absorber 204 come into contact with each other to form a contact area 205. In this structure, the ink-absorber containers are sectioned from each other at a suitable position. Therefore, an ink container having a long length in the height direction can be obtained without increasing the insertion stroke of the ink absorber.

However, in the structure described in Japanese Patent Laid-Open No. 8-224887 (corresponding to U.S. Pat. No. 5,839,595), the number of components is increased because two ink absorbers are used.

Accordingly, to reduce the number of components and costs, a structure in which a single ink absorber is contained in two containers, as shown in FIG. 12A, can be used. However, in this structure, as shown in FIG. 12B, an ink absorber 303 protrudes from wall surfaces of a first ink-absorber container 301 and a second ink-absorber container 302 at bonding portions thereof. If the ink absorber protrudes from the bonding portions, the ink absorber will be sandwiched between welding portions and weld failure will occur. As a result, weld reliability will be reduced.

SUMMARY OF THE INVENTION

The present invention provides an inkjet cartridge in which bonding portions of ink-absorber containers are bonded with high reliability and a method for manufacturing the inkjet cartridge.

In particular, the present invention provides an inkjet cartridge in which a single ink absorber is contained in two containers which are welded together with high weld reliability and a method for manufacturing the inkjet cartridge.

An inkjet cartridge according to an aspect of the present invention includes a main body including a first housing and a second housing which are bonded together at bonding portions thereof and an ink absorber contained in the main body. A section of the ink absorber is processed, the section corresponding to the bonding portions.

An inkjet cartridge according to another aspect of the present invention includes an ink absorber capable of being impregnated with ink and an ink-absorber container. The ink-absorber container includes a first housing containing a portion of the ink absorber and a second housing containing a remaining portion of the ink absorber which is not contained in the first housing. The first housing and the second housing are bonded together at bonding portions thereof. The ink absorber has a melted section at least in an area corresponding to the bonding portions, the processed section being formed by melting a surface of the ink absorber.

A method for manufacturing an inkjet cartridge according to another aspect of the present invention includes preparing an ink-absorber container having a first housing and a second housing; forming a melted section by melting an ink absorber at least in an area corresponding to bonding portions of the first housing and the second housing; storing a portion of the ink absorber in the first housing and a remaining portion of the ink absorber in the second housing after the melted-section forming step; and bonding the first housing and the second housing together at the bonding portions while the ink absorber is stored in the first housing and the second housing.

According to at least one embodiment of the present invention, the ink absorber has a melted area. Therefore, the ink absorber does not protrude from the bonding portions and the bonding reliability of the bonding portions of the ink-absorber containers can be increased.

Further features of the present invention will become apparent from the following description of exemplary embodiments with reference to the attached drawings.

DESCRIPTION OF THE EMBODIMENTS

Exemplary embodiments of the present invention will be described with reference to the accompanying drawings.

First Embodiment

Figure 1:
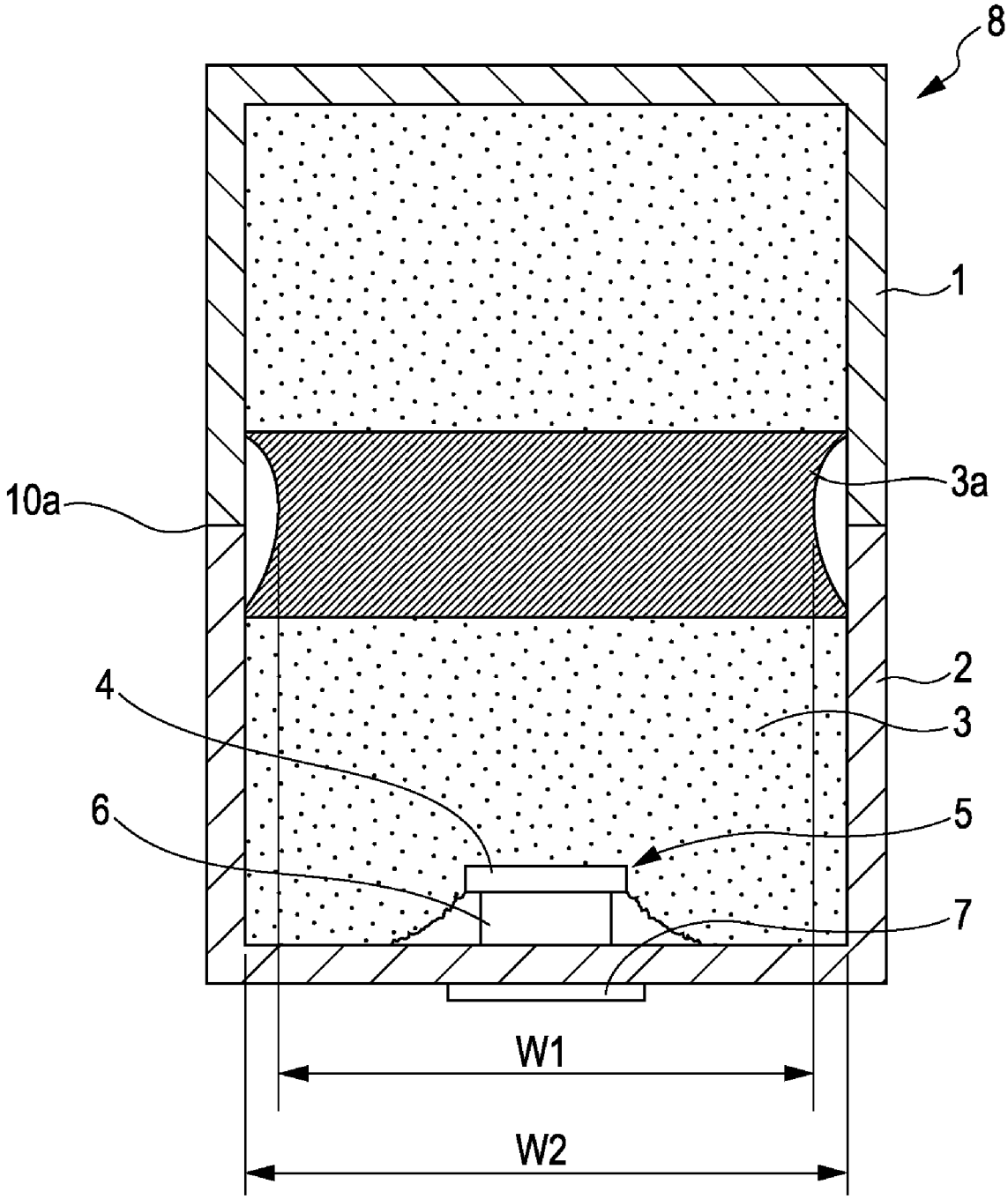
FIG. 1 is a schematic sectional view of an inkjet cartridge according to a first embodiment of the present invention.
Figure 2A:
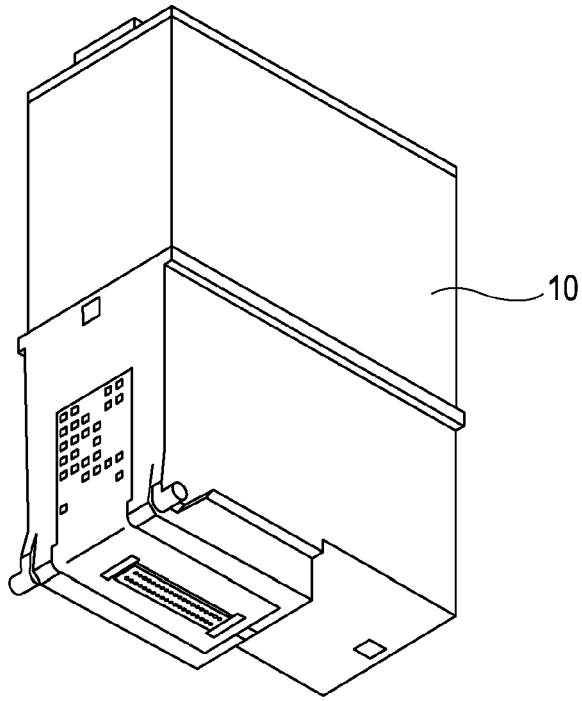
FIGS. 2A and 2B are schematic perspective views of the inkjet cartridge according to the first embodiment of the present invention.
Figure 2B:
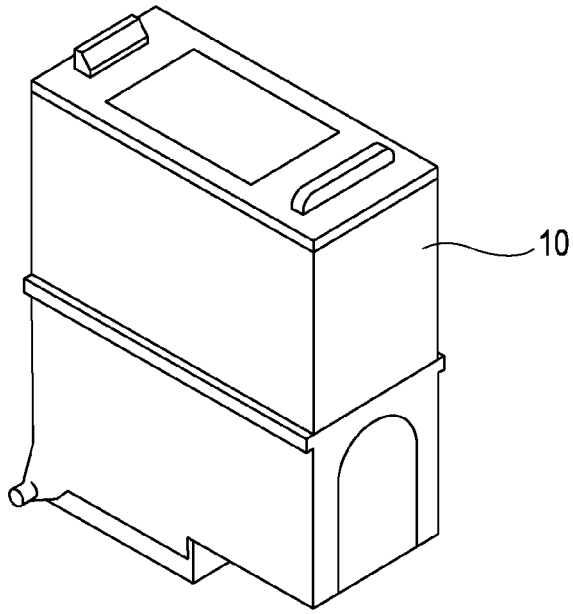
Figure 3A:
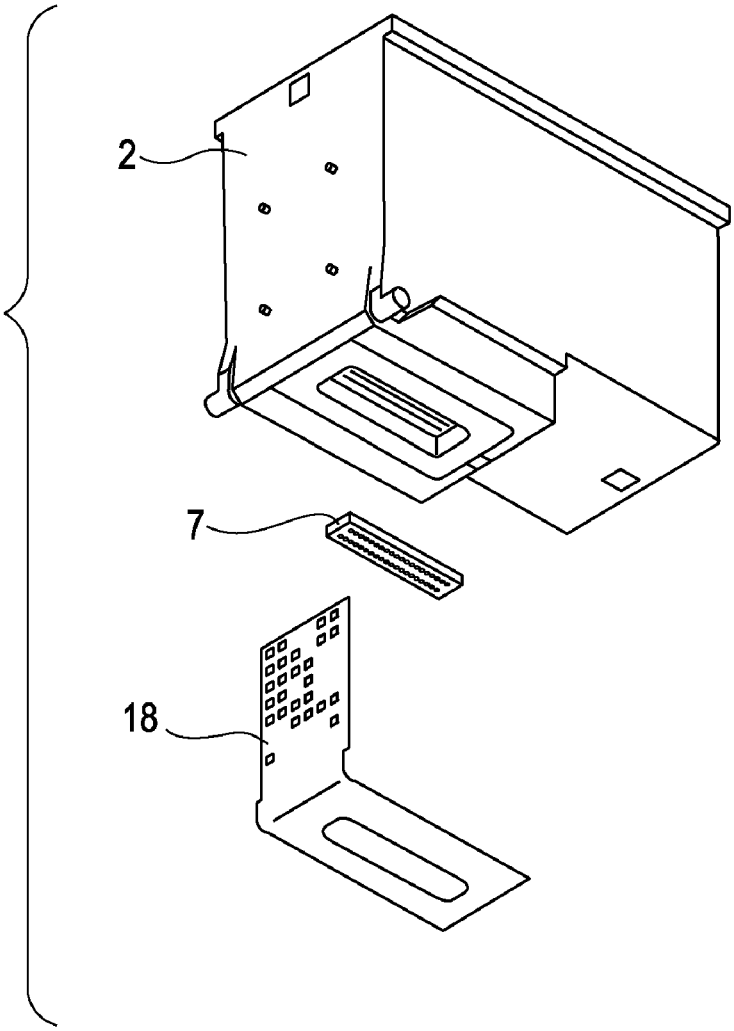
FIGS. 3A and 3B are schematic exploded perspective views of the inkjet cartridge according to the first embodiment of the present invention.
Figure 3B:
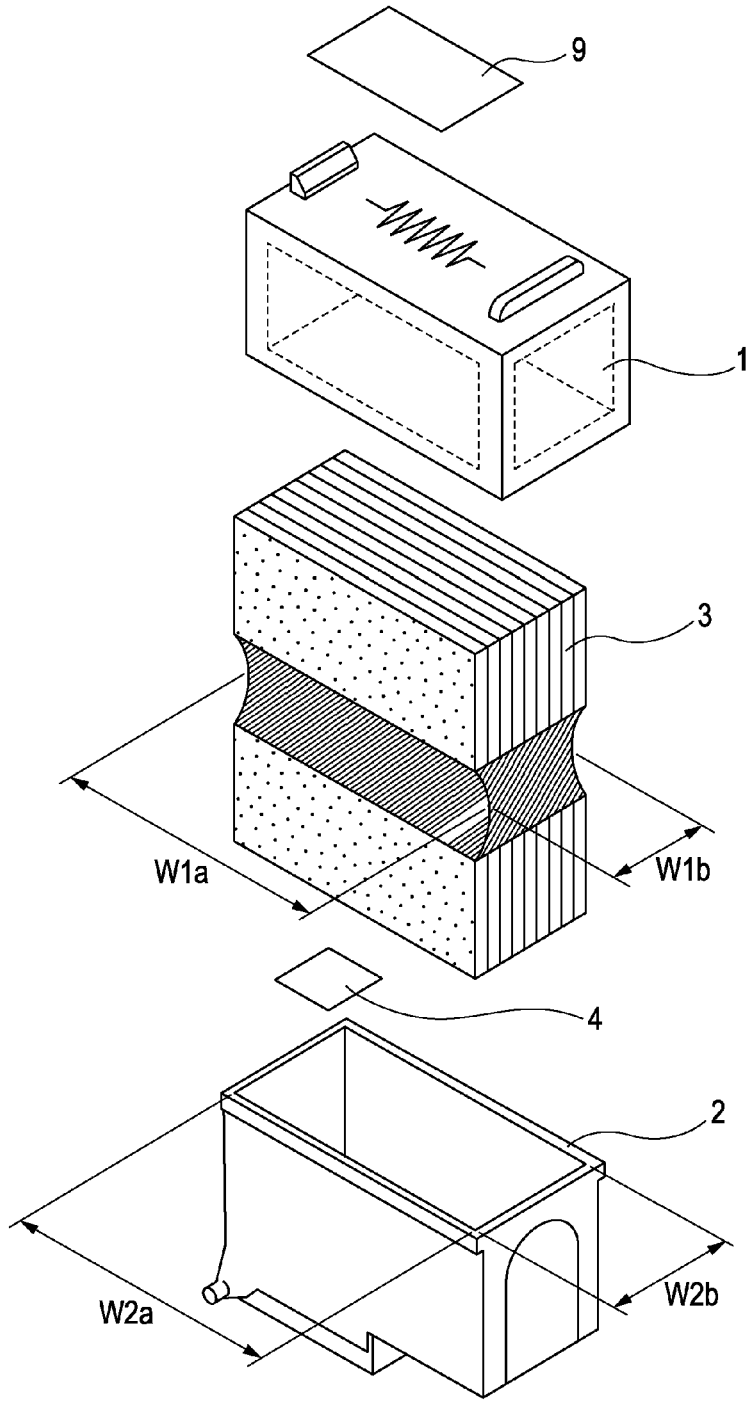
Figure 4B:
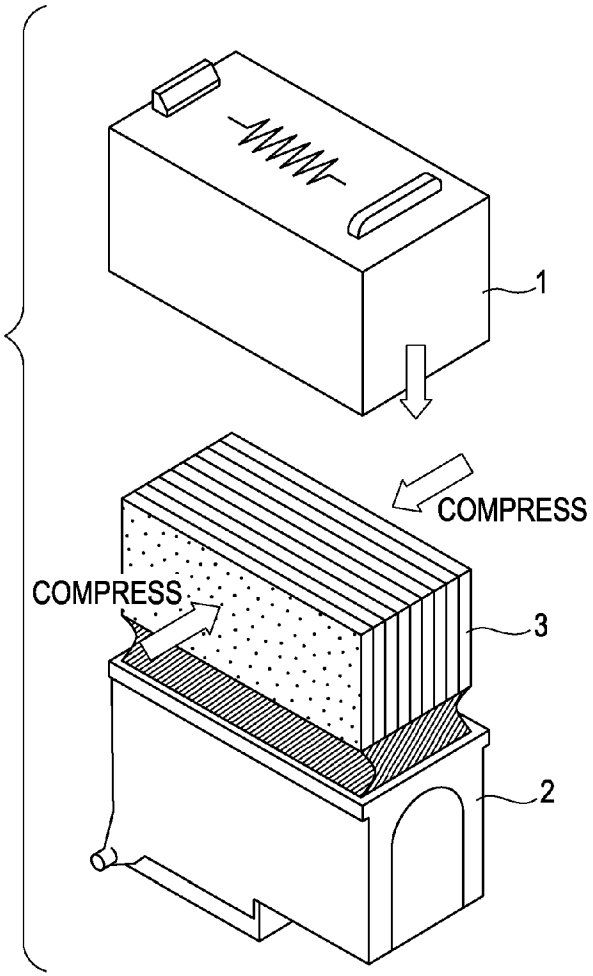
FIGS. 4A and 4B are schematic perspective views illustrating a method for manufacturing the inkjet cartridge according to the first embodiment of the present invention.
Figure 4A:
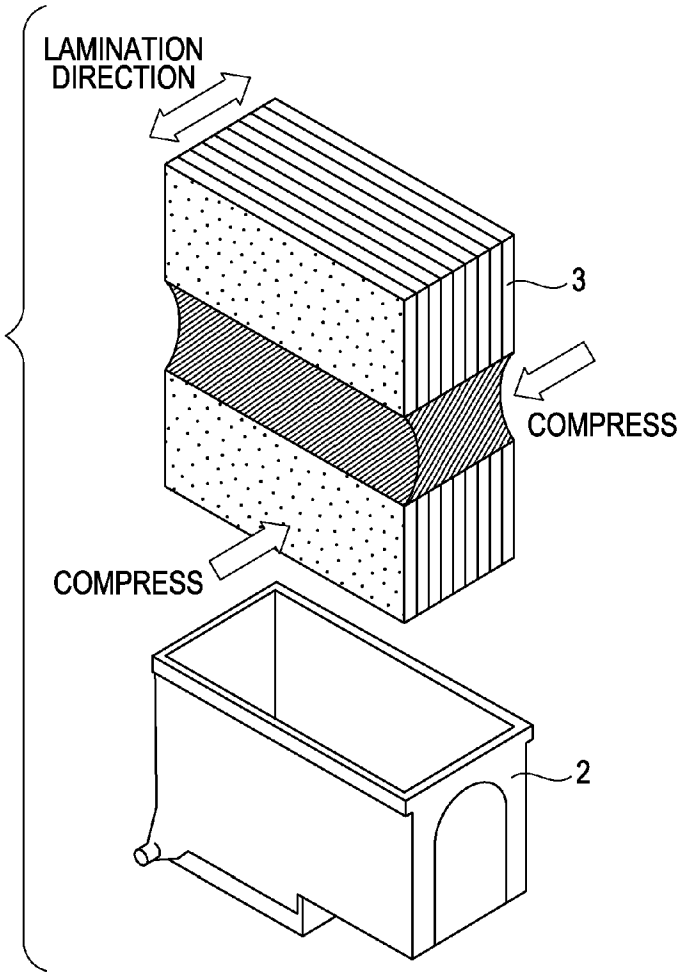
Figure 5:
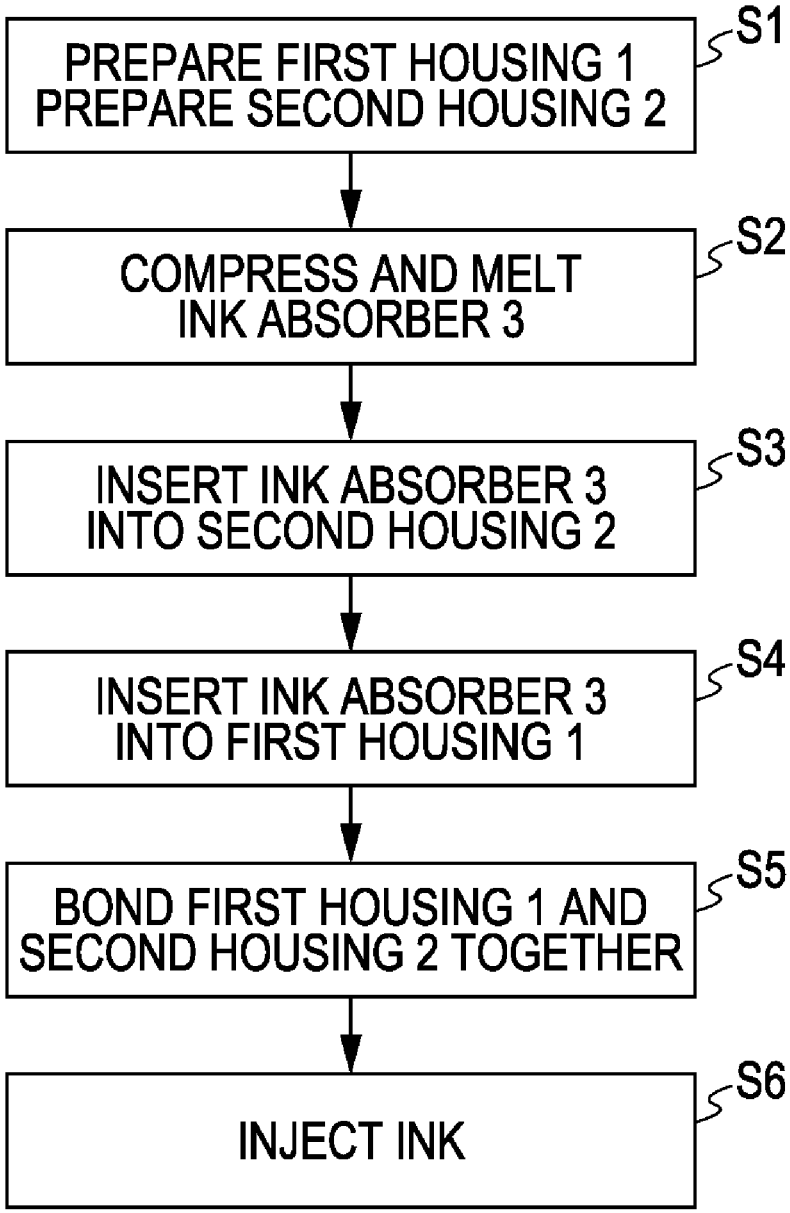
FIG. 5 is a flowchart of the method for manufacturing the inkjet cartridge according to the first embodiment of the present invention.

FIG. 1 is a schematic sectional view of an inkjet cartridge according to a first embodiment. FIGS. 2A and 2B are schematic perspective views of the inkjet cartridge according to the first embodiment. FIGS. 3A and 3B are schematic exploded perspective views of the inkjet cartridge according to the first embodiment. FIGS. 4A and 4B are schematic perspective views illustrating a method for manufacturing the inkjet cartridge according to the first embodiment. FIG. 5 is a flowchart of the method for manufacturing the inkjet cartridge according to the first embodiment.

First, the structure of an inkjet cartridge 10 according to the present embodiment will be described.

The inkjet cartridge 10 shown in FIG. 1 contains ink of a single color and includes a first housing 1 and a second housing 2 which form an ink-absorber container 8. An ink absorber 3 impregnated with ink is stored in the ink-absorber container 8.

As shown in FIG. 3A, an inkjet recording head 7 and an electrical wiring member 18 are attached to a bottom portion of the second housing 2. A tube-shaped ink-introducing portion 5 is provided on the bottom portion of the second housing 2 such that the ink-introducing portion 5 projects into an ink containing space at a position directly above the inkjet recording head 7. The ink-introducing portion 5 forms an ink passage 6 which connects the inner space of the ink-absorber container 8 to the inkjet recording head 7. A filter 4 is disposed at an end of the ink-introducing portion 5 that projects into the ink-absorber container 8.

In other words, the second housing 2 is provided with the ink passage 6 which supplies ink to the outside and the filter 4 which is disposed in the second housing 2 at an end of the ink passage 6. The inkjet recording head 7 is disposed at the other end of the ink passage 6. The top surface of the second housing 2 at the side opposite to the bottom portion at which the ink-introducing portion 5 is formed is open and is closed by the first housing 1. The first housing 1 has a space for containing the ink absorber 3, and a portion of the ink absorber 3 that cannot be contained in the second housing 2 is contained in the first housing 1. Thus, a portion of the ink absorber 3 is contained in the first housing 1, and the remaining portion of the ink absorber 3 is contained in the second housing 2.

The first housing 1 has a slit and thin holes which communicate with the slit so that pressure variation does not occur in the ink absorber 3. Almost the entire area of the slit and thin holes is covered with a sealing member 9.

A section of the bottom portion of the second housing 2 in a region where the inkjet recording head 7 is provided projects from the remaining section. In the inkjet cartridge 10, ink held by the ink absorber 3 flows through the filter 4 disposed at the end of the ink-introducing portion 5, that is, at the inlet of the ink passage 6. Then, the ink passes through the ink passage 6 and is supplied to the inkjet recording head 7.

The ink absorber 3 is formed by, for example, laminating layers of polypropylene (PP) as described in Japanese Patent Laid-Open No. 2000-301740. The ink absorber 3 has a processed section 3*a* that is processed before the ink absorber 3 is inserted into the second housing 2. The processed section 3*a* is formed along an outer peripheral area of the ink absorber 3 at a position near bonding portions of the first housing 1 and the second housing 2. The processed section 3*a* is formed by, for example, heating and melting the ink absorber 3. In the following description, the processed section 3*a* is referred to as a melted section 3*a*.

Next, a method for manufacturing the inkjet cartridge according to the present embodiment will be described with reference to the flowchart shown in FIG. 5.

First, the first housing 1 and the second housing 2 are prepared in step S1.

Next, the ink absorber 3 is melted and pressurized to form the melted section 3*a* in step S2. The process of melting and pressurizing the ink absorber 3 will be described below.

Next, the ink absorber 3 is inserted into the second housing 2 in step S3. Then, the ink absorber 3 in this state is inserted into the first housing 1 in step S4.

Next, the first housing 1 and the second housing 2 in which the ink absorber 3 is contained are bonded together in step S5. A method for bonding the first housing 1 and the second housing 2 together will also be described below.

Thus, the ink-absorber container 8 is obtained. Then, ink is injected into the ink-absorber container 8 in step S6.

A method for forming the melted section 3*a* of the ink absorber 3 in step S2 will now be described in detail.

Figure 6:
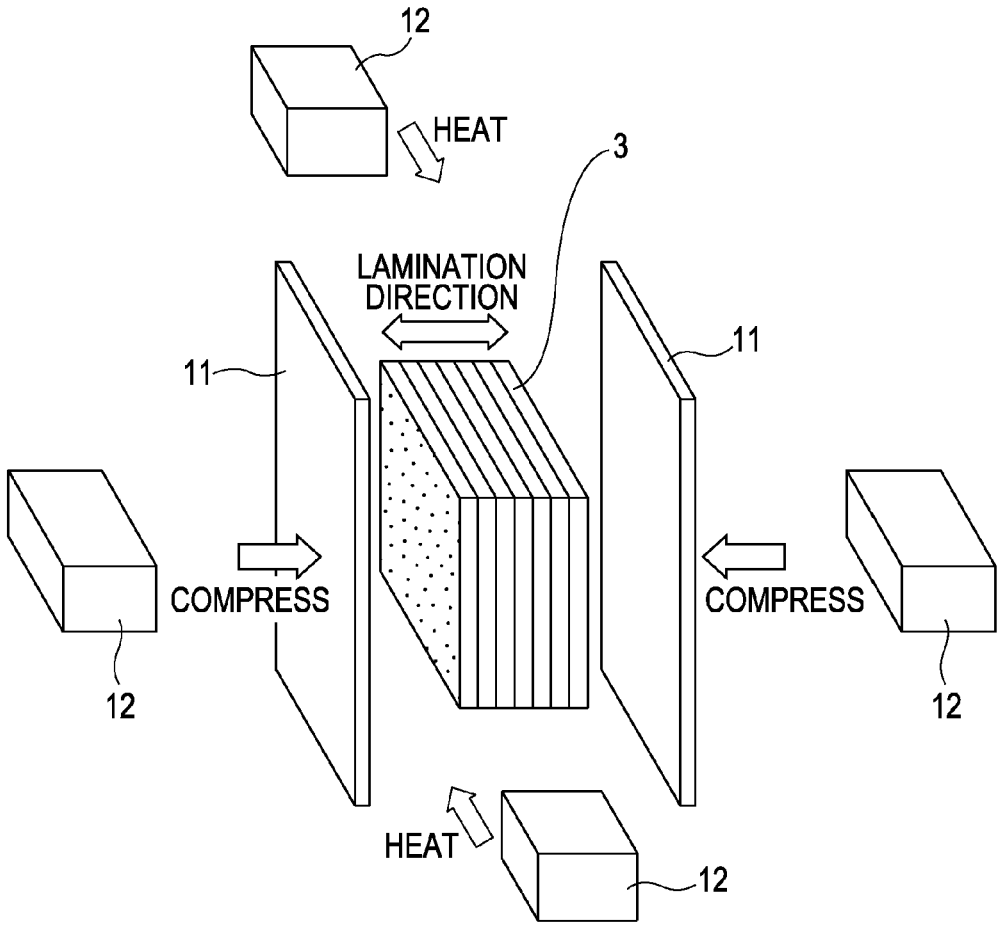
FIG. 6 is a schematic diagram illustrating a method for melting an ink absorber according to the first embodiment of the present invention.

FIG. 6 shows an example of a method for melting the ink absorber 3. First, the ink absorber 3 is compressed with compression boards 11 in a lamination direction. In this state, heating blocks 12 are pressed against the ink absorber 3 in the lamination direction and a direction perpendicular to the lamination direction. Thus, a section of the ink absorber 3 which corresponds to the bonding portions of the first housing 1 and the second housing 2 is melted, and the melted section 3*a* is formed as a result. The method for melting the ink absorber 3 is not limited to the above-described method. For example, the melted section 3*a* may also be formed by melting the ink absorber 3 by applying a chemical solution.

The ink absorber 3 is inserted into the second housing 2 while the ink absorber 3 is compressed in the fiber lamination direction, and is then inserted into the first housing 1 in a similar manner. In this step, the ink absorber 3 is compressed such that the size thereof is sufficiently reduced relative to the inner dimension of the ink-absorber container 8. The ink absorber 3 is inserted into the second housing 2 by using, for example, a cylinder such that pressure and insertion stroke suitable for the ink absorber 3 to be in contact with the filter 4 can be obtained.

A method for bonding the first housing 1 and the second housing 2 together in step S5 will now be described in detail.

The first housing 1 and the second housing 2 are bonded together by vibration welding at bonding surfaces thereof while the first housing 1 and the second housing 2 are set to a jig unit including an upper jig 13 and a lower jig 14 in a vibration welding apparatus 15.

Figure 7A:
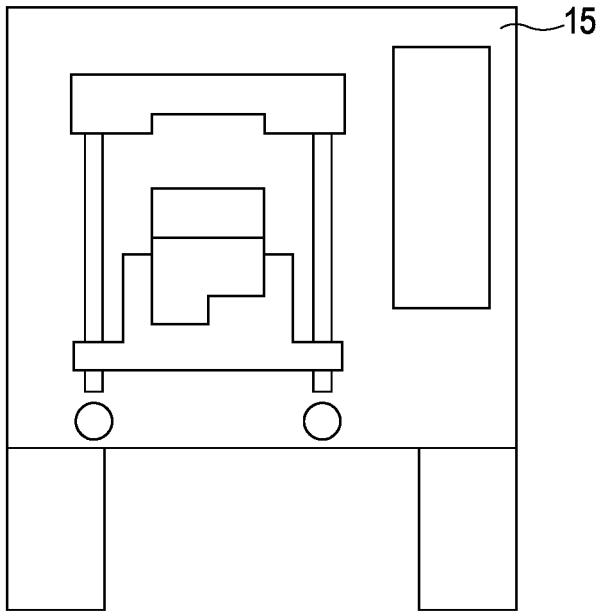
FIGS. 7A and 7B are schematic diagrams illustrating the structure of a vibration welding apparatus and the structure including an upper jig and a lower jig.
Figure 7B:
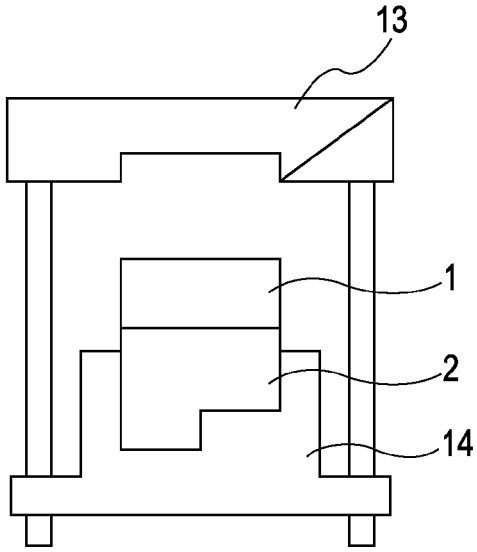

FIG. 7A is a schematic diagram illustrating the vibration welding apparatus 15 in the state in which the first housing 1 and the second housing 2 are set to the jig unit including the upper jig 13 and the lower jig 14. FIG. 7B is a schematic diagram illustrating the state in which the first housing 1 and the second housing 2 are set to the jig unit including the upper jig 13 and the lower jig 14.

First, the first housing 1 and the second housing 2 are placed on the lower jig 14 of the vibration welding apparatus 15 such that the bonding surfaces of the first housing 1 and the second housing 2 face each other. Then, the lower jig 14 is raised upward until the first housing 1 comes into contact with the upper jig 13 and is fixed to the upper jig 13 by absorption. Next, vibration is applied in the state in which load is applied to the first housing 1 and the second housing 2. Thus, the vibration welding process is started.

As shown in FIG. 1, the melted section 3*a* of the ink absorber 3 according to the present embodiment has a concave shape in a central area thereof. The outer peripheral dimension of the melted section 3*a* in the concave area thereof is 2×(W1*a*+W1*b*) (see FIG. 3B). The inner peripheral dimension of the bonding portions 10*a* of the first housing 1 and the second housing 2 is 2×(W2*a*+W2*b*) (see FIG. 3B). In the present embodiment, the outer peripheral dimension of the melted section 3*a* of the ink absorber 3 (W1) is smaller than the inner peripheral dimension of the bonding portions 10*a* (W2).

Figure 12A:
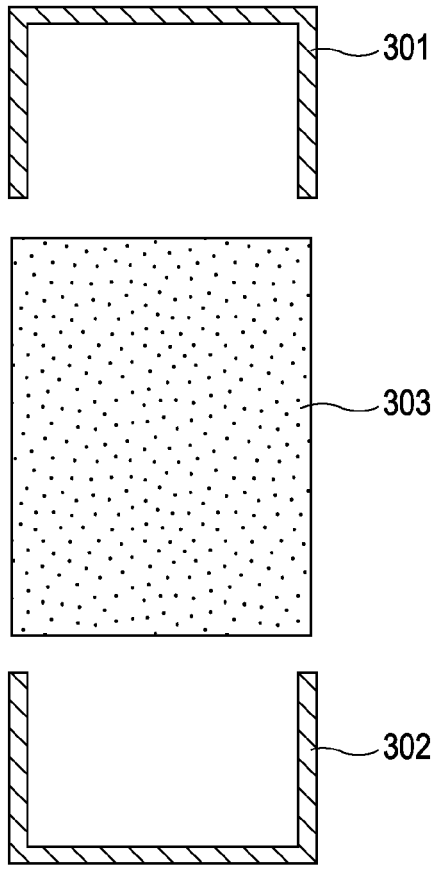
FIG. 12A PRIOR ART
FIGS. 12A and 12B are diagrams illustrating a problem which occurs when an ink absorber is placed in ink-absorber containers in a known inkjet cartridge.
Figure 12B:
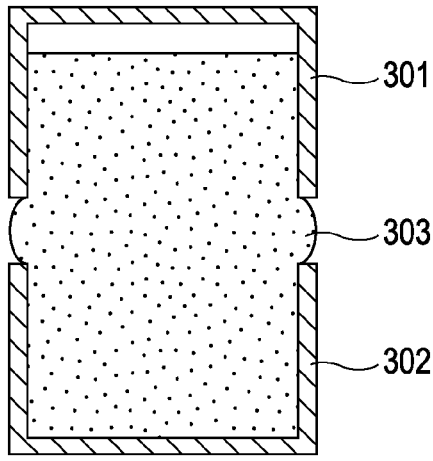
FIG. 12B PRIOR ART

In other words, as shown in FIG. 1, a space is formed between the melted section 3*a* of the ink absorber 3 and the bonding portions 10*a* when the ink absorber 3 is placed in the ink-absorber container 8. Therefore, the ink absorber can be prevented from being sandwiched as shown in FIG. 12B in the process of bonding the first housing 1 and the second housing 2 together, and the contact area between the ink absorber and the welding portions can be reduced in the vibration welding process.

In addition, according to the present embodiment, a surface layer of the melted section 3*a* of the ink absorber 3 is melted. Therefore, generation of small fiber dust can be prevented and weld reliability can be increased.

In addition, according to the present embodiment, the ink-absorber container 8 is divided into the first housing 1 and the second housing 2. Therefore, the insertion stroke by which the absorber 3 is inserted into the second housing 2 is small. As a result, the ink absorber 3 can be reliably pressed against the filter 4. If the ink absorber 3 cannot be tightly pressed against the filter 4, there is a risk that air bubbles will be mixed and ink cannot be reliably supplied. In such a case, there is a risk that thinning or the like will occur. In contrast, in the inkjet cartridge according to the present embodiment, the ink absorber 3 can be reliably pressed against the filter 4 as described above. Therefore, reduction in print quality can be prevented.

In the above-described example, the processed section is formed by melting the corresponding portion of the ink absorber. However, the processing method is not limited to this.

For example, the surface of the corresponding portion of the ink absorber may be hardened by heating the surface. The method for hardening the surface is not limited to heating, and the surface of the ink absorber may be hardened by applying a chemical solution.

Alternatively, the processed section may be formed by cutting the surface of the ink absorber such that the area including the corresponding portion has a concave shape.

Alternatively, the processed section may be formed in the concave shape by compressing and deforming the corresponding portion of the ink absorber.

In any case, it is important that a portion of the ink absorber be processed such that the ink absorber does not protrude from the bonding portions of the first housing and the second housing.

Second Embodiment

Figure 8B:
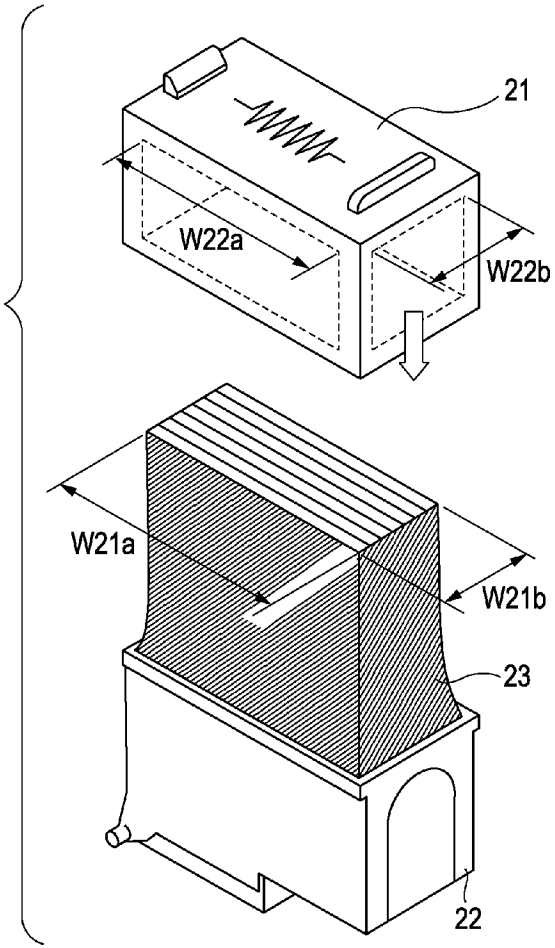
FIGS. 8A and 8B are exploded perspective views of an inkjet cartridge according to a second embodiment of the present invention.
Figure 8A:
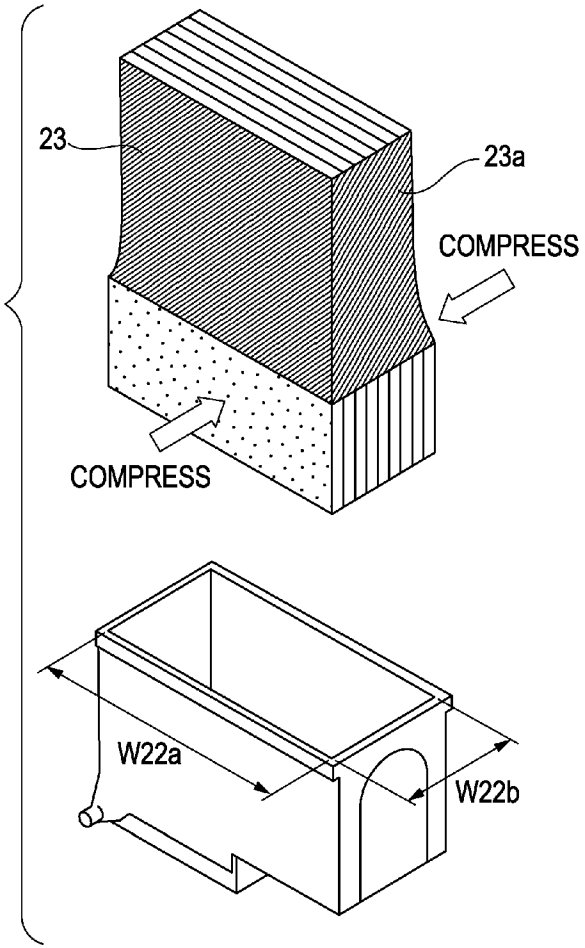
Figure 9:
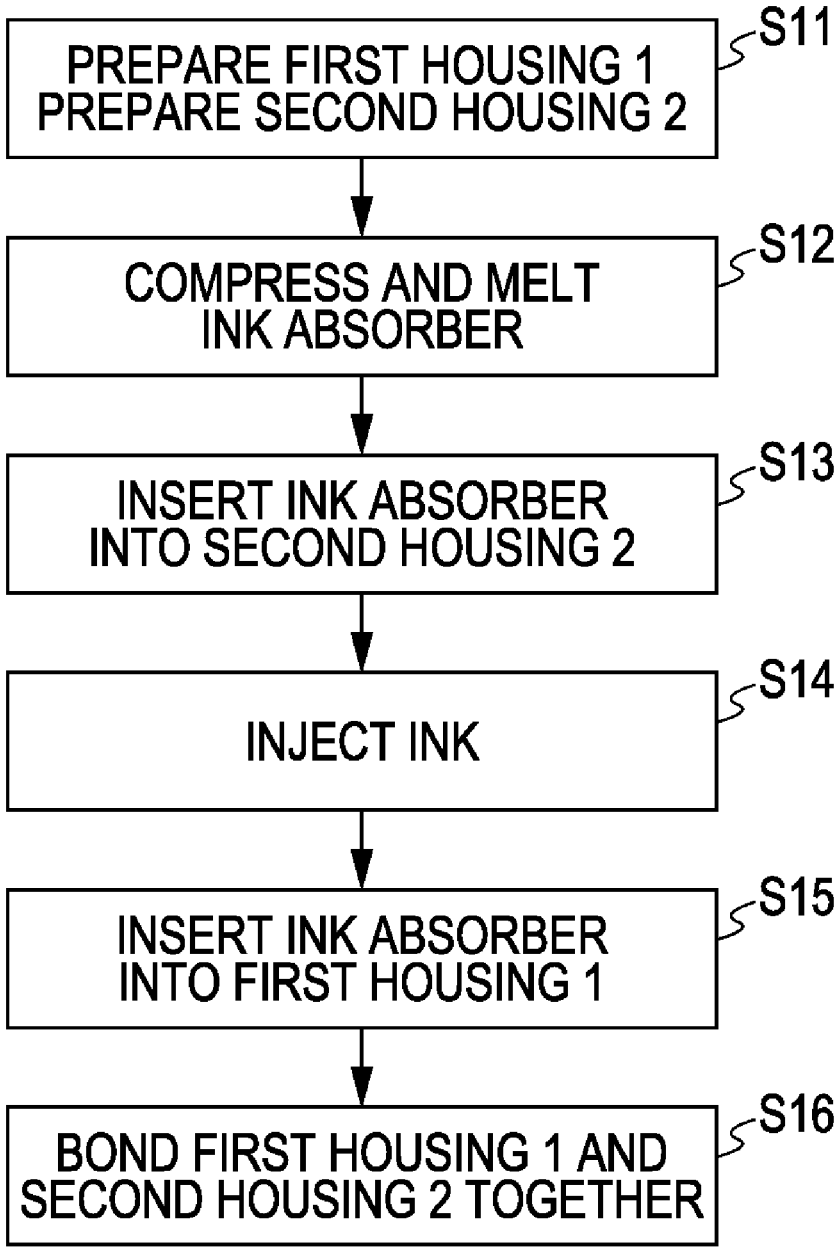
FIG. 9 is a flowchart of a method for manufacturing the inkjet cartridge according to the second embodiment of the present invention.
Figure 10:
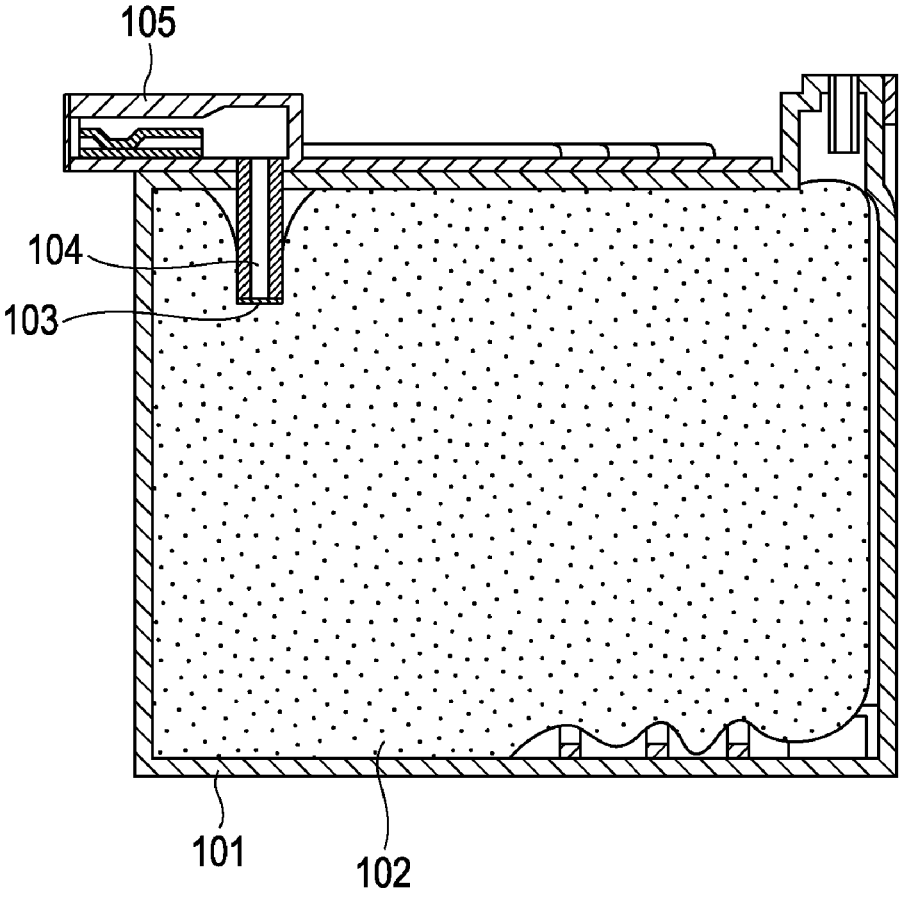
FIG. 10 PRIOR ART
FIG. 10 is a sectional side view illustrating an example of a known inkjet cartridge.
Figure 11A:
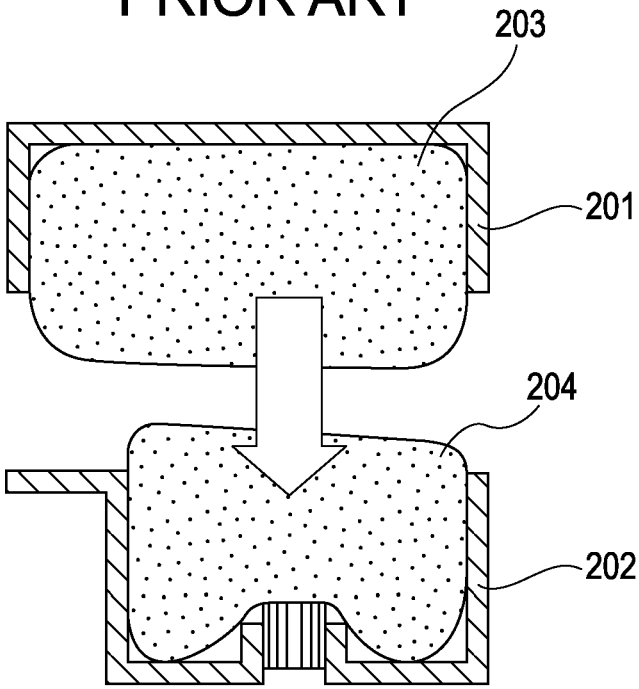
FIG. 11A PRIOR ART
FIGS. 11A and 11B are sectional side views of another example of a known inkjet cartridge.
Figure 11B:
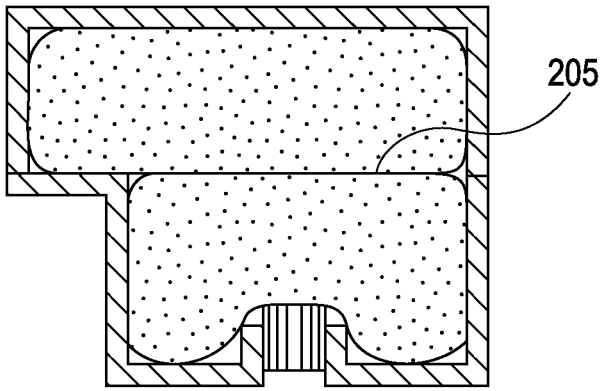
FIG. 11B PRIOR ART

FIGS. 8A and 8B are schematic exploded perspective views of an inkjet cartridge according to a second embodiment. FIG. 9 is a flowchart of a method for manufacturing the inkjet cartridge according to the second embodiment.

In the first embodiment, the melted section 3*a* of the ink absorber 3 is formed only in an area near the bonding portions of the first housing 1 and the second housing 2. In contrast, an ink absorber 23 according to the present embodiment has a melted section 23*a* which is formed not only in an area near bonding portions of a first housing 21 and a second housing 22 but in the entire area in which the ink absorber 23 is contained in the first housing 21.

The outer peripheral dimension of a portion of the ink absorber 23 that is contained in the first housing 21 is 2×(W21*a*+W21*b*), and the inner peripheral dimension of the first housing 21 and the second housing 22 is 2×(W22*a*+W22*b*). Also in the second embodiment, similar to the first embodiment, the outer peripheral dimension of the ink absorber 23 is smaller than the inner peripheral dimension of the first housing 21 and the second housing 22. Therefore, the ink absorber 23 can be prevented from being sandwiched between the bonding portions and the contact area between the ink absorber and the welding portions can be reduced in the vibration welding process. In addition, according to the present embodiment, a surface layer of the melted section 23*a* of the ink absorber 23 is melted. Therefore, generation of small fiber dust can be prevented and weld reliability can be increased.

In addition, according to the present embodiment, similar to the first embodiment, an ink-absorber container is divided into the first housing 21 and the second housing 22, therefore the insertion strokes by which the ink absorber 23 is inserted into the second housing 22 is small. Thus, the ink absorber 23 can be reliably pressed against the filter. As a result, the print quality can be maintained and thinning and the like can be prevented.

The melted section 23*a* of the ink absorber 23 also serves to prevent the outward movement of the ink. Thus, ink can be more reliably prevented from leaking through the bonding portions of the ink-absorber container.

As shown in FIG. 9, the ink can be injected before the ink-absorber container is assembled. A method for manufacturing the inkjet cartridge according to the present invention will be described with reference to the flowchart shown in FIG. 9.

First, the first housing 21 and the second housing 22 are prepared in step S11.

Next, the ink absorber 23 is melted and pressurized to form the melted section 23*a* in step S12.

Next, the ink absorber 23 is inserted into the second housing 22 in step S13.

Next, the ink is injected into the ink absorber 23 in step S14. In the first embodiment, the ink is injected after the first housing 21 and the second housing 22 are bonded together. According to the present embodiment, the entire surface of the ink absorber 23 is melted. Therefore, even if the ink is injected into the ink absorber 23 while the ink absorber 23 protrudes from the second housing 22, the ink absorber 23 can be impregnated with the ink without causing the ink to leak from the ink absorber 23.

As described above, according to the present embodiment, versatility of the manufacturing process can be increased. In addition, since the surface of the ink absorber 23 is melted and hardened, a plurality of ink injection needles can be inserted into the ink absorber 23. Therefore, according to the present embodiment, the time required for impregnating the ink absorber 23 can be reduced.

Then, the ink absorber 23 in this state is inserted into the first housing 21 in step S15.

Lastly, the first housing 21 and the second housing 22 in which the ink absorber 23 is contained are bonded together in step S16.

The area in which the melted section 23*a* is formed in the ink absorber 23 according to the present embodiment is not limited to the area corresponding to the first housing 21. The melted section 23*a* may be formed in various areas in accordance with the positional relationship between the ink absorber 23 and the filter which comes into contact with the ink absorber 23 or the process of inserting the ink absorber 23 into the ink-absorber container 8.

As described in the first embodiment, it is important that a portion of the ink absorber be processed such that the ink absorber does not protrude from the bonding portions of the first housing and the second housing. With regard to the processing method, methods described in the first embodiment may also be applied in the second embodiment.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-310919 filed Nov. 30, 2007, which is incorporated by reference herein in its entirety.

What is claimed is:

1. An ink cartridge, comprising:

a main body configured by bonding a first housing and a second housing at a bonding portion thereof; and a single ink absorber contained in the main body, wherein the single ink absorber has a section having a concave shape in a position corresponding to the bonding portion, the section of the ink absorber having the concave shape in the position prior to being contained in the main body, and wherein a gap is provided, when the single ink absorber is contained in the main body, between the section of the single ink absorber and the bonding portion of the main body.

2. The ink cartridge according to claim 1, wherein the section of the ink absorber is processed by melting the ink absorber in a surface area including the section.

3. The ink cartridge according to claim 1, wherein the section of the ink absorber is processed by hardening the ink absorber in a surface area including the section.

4. The ink cartridge according to claim 1, wherein the section of the ink absorber is processed by cutting the ink absorber such that a surface of the ink absorber is concave in an area including the section.

5. The ink cartridge according to claim 1, wherein the section of the ink absorber is processed by compressing and deforming the ink absorber to form a concave portion in an area including the section.

6. The ink cartridge according to claim 1, wherein the ink absorber is composed of fiber.

7. An inkjet cartridge, comprising:

a single ink absorber capable of being impregnated with ink; and an ink-absorber container configured by bonding a first housing containing a portion of the ink absorber and a second housing containing a remaining portion of the ink absorber which is not contained in the first housing, the first housing and the second housing being bonded together at bonding portions thereof, wherein the single ink absorber has a section having a concave shape in a position corresponding to the bonding portion, the section of the ink absorber having the concave shape in the position prior to being contained in the main body, and wherein a gap is provided, when the single ink absorber is contained in the main body, between the section of the single ink absorber and the bonding portion of the main body.

8. The inkjet cartridge according to claim 7, wherein the position corresponding to the bonding portion includes a surface of the portion of the ink absorber.

9. The inkjet cartridge according to claim 7, wherein the position corresponding to the bonding portion includes a surface of the remaining portion of the ink absorber.

10. The inkjet cartridge according to claim 7, wherein the second housing includes an ink passage through which ink is supplied to the outside and a filter disposed in the second housing at one end of the ink passage, and further comprising an inkjet recording head configured to eject ink and disposed at the other end of the ink passage.

11. A method for manufacturing an inkjet cartridge, comprising:

preparing an ink-absorber container having a first housing and a second housing;

forming a melted section by melting an area corresponding to a bonding portion of the first housing and the second housing, wherein the melted section has a concave shape;

storing a portion of a single ink absorber in the first housing and a remaining portion of the single ink absorber in the second housing; and bonding the first housing and the second housing together at the bonding portion, wherein a gap is provided, when the single ink absorber is stored in the main body, between the melted section having the concave shape of the single ink absorber and the bonding portion of the main body.

12. The method according to claim 11, further comprising: impregnating the ink absorber with ink after the storing step and before the bonding step.

13. The method according to claim 11, wherein the second housing prepared in the preparing step includes an ink passage through which ink is supplied to the outside and a filter disposed in the second housing at one end of the ink passage.

* * * * *